US005426404A

United States Patent [19]

Kommrusch et al.

[11] Patent Number: 5,426,404

[45] Date of Patent: Jun. 20, 1995

[54] ELECTRICAL CIRCUIT USING LOW VOLUME MULTILAYER TRANSMISSION LINE DEVICES

[75] Inventors: Richard S. Kommrusch; Wang-Chang A. Gu, both of Albuquerque, N. Mex.

[73] Assignee: Motorola, Inc., Schaumburg, Ill.

[21] Appl. No.: 189,030

[22] Filed: Jan. 28, 1994

[51] Int. Cl.[6] ..... H01P 5/00

[52] U.S. Cl. ..... 333/246; 333/128; 333/161; 333/162; 336/200

[58] Field of Search ..... 333/26, 116, 128, 161, 333/162, 204, 219, 238, 246, 1; 336/200

[56] References Cited

U.S. PATENT DOCUMENTS 4,494,083 1/1985 Josefsson et al. ..... 333/246 X
4,701,727 10/1987 Wong ..... 333/204
5,146,191 9/1992 Mandai et al. ..... 333/161

*Primary Examiner*—Paul Gensler
*Attorney, Agent, or Firm*—James A. Coffing

[57] ABSTRACT

An electrical circuit (500) includes an input means (503) for providing an input signal, an output means for providing an output signal, and a transmission line device (421) disposed substantially between the input means (503) and the output means. The transmission line device inludes a first ground plane (505) disposed on a first dielectric substrate (502), and a first conductive layer (421-1) disposed, and enclosing a first area, on a second dielectric substrate (506) that is positioned substantially adjacent to the first dielectric substrate (502). The transmission line device (421) further includes a second conductive layer (421-2) that encloses an area corresponding to the first area on a first major surface of a third dielectric substrate (504) that is positioned substantially adjacent to the second dielectric substrate (506).

2 Claims, 6 Drawing Sheets

100

200

300

ELECTRICAL CIRCUIT USING LOW VOLUME MULTILAYER TRANSMISSION LINE DEVICES

FIELD OF THE INVENTION

The present invention relates generally to electrical circuits, and in particular to such circuits that require low volume transmission line devices.

BACKGROUND OF THE INVENTION

Electrical transmission lines are used to transmit electric energy and signals from one point to another. The basic transmission line connects a source to a load—e.g. a transmitter to an antenna, an antenna to a receiver, or any other application that requires a signal to be passed from one point to another in a controlled manner. Electrical transmission lines, which can be described by their characteristic impedance and their electrical length, are an important electric component in radio frequency (RF) circuits. In particular, transmission lines can be used for impedance matching—i.e., matching the output impedance of one circuit to the input impedance of another circuit. Further, the electrical length of the transmission line, typically expressed as a function of signal wavelength, determines another important characteristic of the transmission line device.

Manipulation of the characteristic impedance and electrical length of the transmission line device is a well known technique to effect a particular electrical result. In particular, an output impedance, $Z_{out}$, can be matched to an input impedance, $Z_{in}$, according to a well known equation, as later described. Similarly, the attenuation and phase shift of the transmission line device can be altered by changing the physical length of the conductor between the input and output ports of the transmission line device. As an example, a resonant circuit results when the physical length of the conductor approximates an even one-quarter wavelength of the signal's nominal frequency.

Of course, at high frequencies the wavelength is small and transmission line devices can be built using relatively short conductors in small packages. By contrast, as the nominal frequency of the applied signal decreases, the physical length must necessarily increase to effect the desired transmission line characteristic. The physical length must correspondingly increase to accommodate such applications operating at lower frequencies.

Prior art techniques, including microstrip and stripline conductors, have been used successfully in the past to construct transmission line devices. Unfortunately, at lower frequencies—e.g., below 1 GHz13 the substrates upon which these one-dimensional conductive strips are placed require a relatively large area, due to the excessive length requirements. As today's electronic devices shrink in size, the board space allotted for the necessary electrical components is correspondingly reduced. Thus, a substrate carrying a microstrip or a stripline conductor that serves as a transmission line device for low frequency signals simply cannot be accommodated by the available board space.

Another technique that is employed can be described as a helical structure disposed inside a grounding cylinder. Such helical coils are well known in the art, but these too are often inadequate for today's applications, where low volume and low cost are critical factors in the manufacture of portable electronic devices. Because of the tight length and impedance specifications, the helical structures become very costly to manufacture. That is, the manufacturing variance that is inherent in the construction of such devices—e.g. conductor diameter, symmetry of windings, and effective number of turns—tends to make the helical structure a less desirable solution for tight tolerance transmission line devices. Further, the cylindrical grounding portion, which feature is required when building a transmission line device, results in a circuit having a relatively large volume, or poor form-factor, that is untenable for many of today's applications.

Of course, circuits that employ more than one transmission line device—or one having a relatively long electrical length requirement—suffer from increasing gains in volume associated with prior art devices. Such circuits include complex impedance transformers, quarter-wave resonators, and power splitters/combiners that require two or more transmission line devices to effect the desired result. Aside from the increased area and volume requirements, circuits employing multiple transmission lines on a single substrate must account for undesired interference between the two devices that might substantially effect their performance. In particular, if the transmission line structures are placed substantially adjacent to one another, an undesired coupling effect occurs that results, inter alia, in a reduced quality factor (Q), and reduced control of the characteristic impedance of the devices. Further, when the devices are positioned substantially parallel to each other, the result is an undesired coupling of the electromagnetic fields radiating from each of the structures. This undesired coupling often results in additional loss and performance degradation.

Accordingly, there exists a need for a circuit configuration capable of employing multiple, or lengthy, transmission line devices in a manner that reduces the volume requirements as compared to prior art circuits. Further, such a circuit that also oriented the transmission line devices in such a manner so as to substantially eliminate any undesired coupling effects between them would be an improvement over the prior art.

DETAILED DESCRIPTION OF A PREFERRED EMBODIMENT

A circuit that requires transmission line devices can advantageously employ multi-layer ceramic processing techniques to provide transmission line devices. The electrical circuit includes at least a first input terminal and a first output terminal for providing electrical access to at least a first transmission line device. The first transmission line device includes at least a first ground plane located on a first dielectric substrate, a first conductive layer disposed on a second dielectric substrate that is substantially adjacent to the first dielectric substrate and a second conductive layer disposed on a first major surface of a third dielectric substrate. The first and second conductive layers each at least partially enclose a corresponding area on their respective dielectric substrates. Arranging the conductive layers and the substantially adjacent ground plane in this manner facilitates a circuit design requiring increased electrical length and a more controllable characteristic impedance for the transmission line device. Further, integration of each stage of a plurality of multilayer devices onto the same substrate advantageously provides control of the transmission line characteristics.

Figure 1:
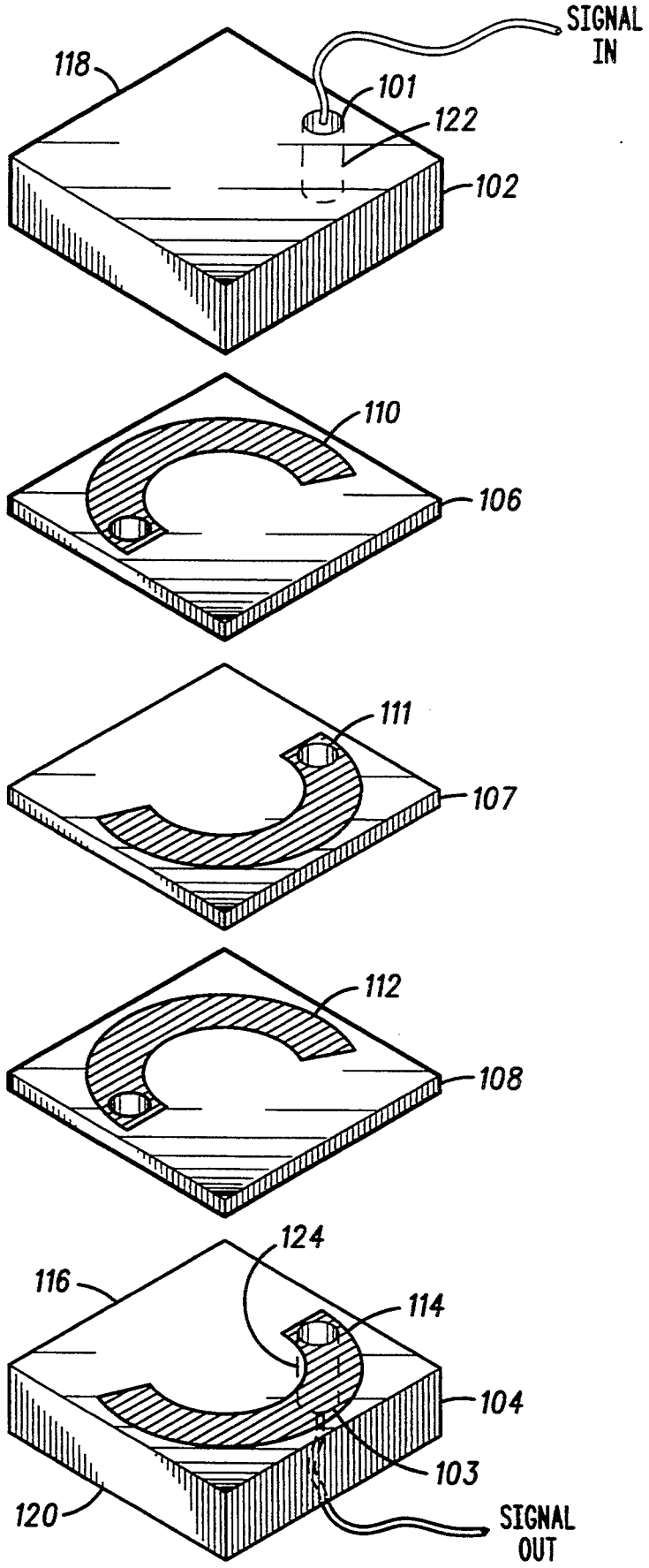
FIG. 1 shows a multilayer ceramic transmission line device using vertically stacked half-ring conductors, in accordance with the present invention.

The present invention can be more fully described with reference to FIGS. 1–6. FIG. 1 shows a multilayer substrate arrangement 100 that, when assembled, provides a device having transmission line characteristics. That is, a transmission line device is formed between a signal input port 101 disposed on a top substrate 102 and a signal output port 103 disposed on a bottom substrate 104. Further, intermediate substrates 106–108 (three shown, but there could be more) provide support structure for conductive patterns, or layers 110–112, which layers at least partially enclose an area on their respective dielectric substrates 106–108. Another conductive layer 114 is disposed on a first major surface 116 of the bottom substrate 104. The top substrate 102 further includes a metallized area 118 that serves as a ground plane for the transmission line device. Similarly, the bottom substrate 104 preferably includes a second ground plane, disposed on a second major surface 120 thereof, which second ground plane generally insures a more stable circuit package due to the shielding, symmetry and boundary effects of the second ground plane. Finally, conductive vias 122, 124 are used to carry the input and output signals through the top substrate 102 and the bottom substrate 104, respectively. In this manner, a multiple-turn coil is provided that is substantially adjacent to one, or preferably two, ground plane(s) to effect a low-volume transmission line device.

In a preferred embodiment, the dielectric substrates 102, 104, 106–108 are formed using ceramic materials that can be co-fired with a co-fireable metal composition. Further, the conductive layers 110–112, 114 are preferably deposited on the dielectric substrates as provided by, for example, DuPont's Green Tape TM, Systems, thereby producing conductive layers having relatively high conductance values. Similarly, the conductive vias 122, 124—as well as the vias formed on the intermediate substrates 106—108, not shown—are made by metallizing the inner surfaces of spatially arranged, pre-punched holes in the ceramic using the co-fireable metal composition. Lastly, it should be noted that while conductive layers 110–112 are shown in FIG.1 as being annulus structures in the form of a half-ring, other annulus structures can be readily employed depending on the application requirements, as next described. Further, while input/output terminals are shown here as being on opposite surfaces of the package, it is understood that they could easily be placed on the same surface. It is critical only that the transmission line device is electrically positioned between the input and output terminals.

Figure 2:
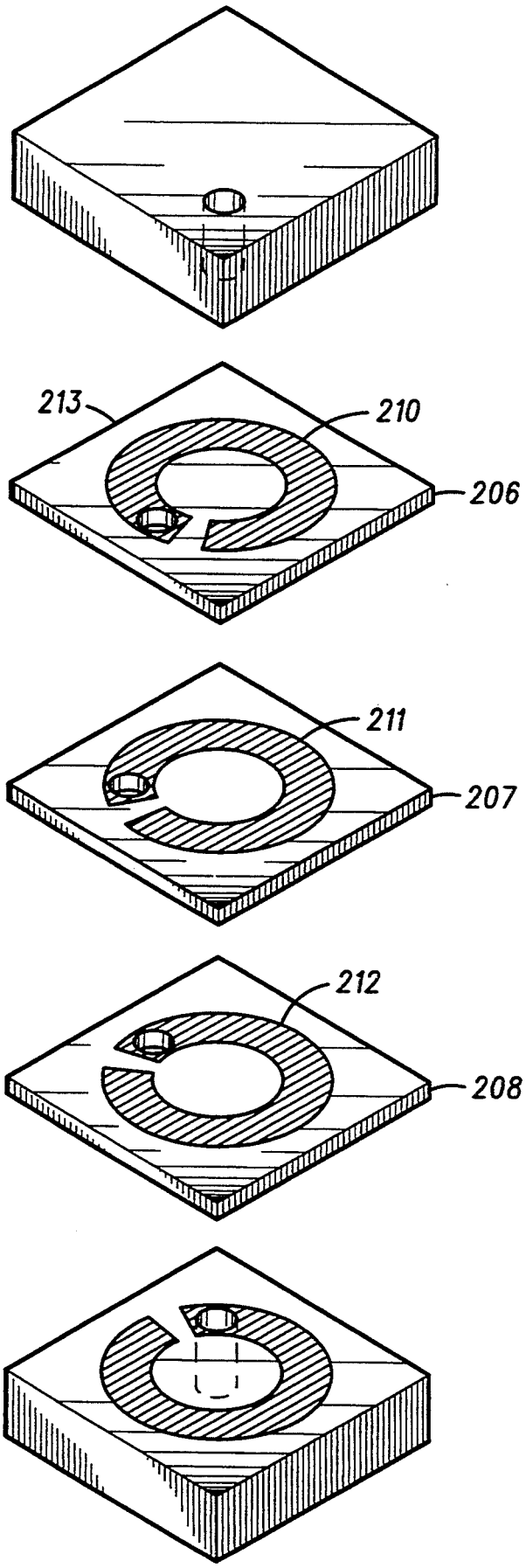
FIG. 2 shows a multilayer ceramic transmission line device using vertically stacked full-ring conductors, in accordance with the present invention.

FIG. 2 shows a a multilayer substrate arrangement 200 that employs full-ring annulus structures as the conductive layers, in accordance with an alternate embodiment of the invention. That is, annulus 210 comprises a nearly complete circular layer that substantially encloses an area 213 on dielectric substrate 206. Similarly, annuli 211,212 comprise near complete circular layers that substantially enclose areas on their dielectric substrates 207, 208, respectively, which areas correspond to the substantially enclosed area 213. Employing annulus structures 210–212 in this manner provides for increasing the physical length of the conductive layers—and hence the electrical length of the transmission line—using the same number of ceramic layers. Of course, this allows for reduced volume of dielectric material required and significantly lower manufacturing costs, as compared to transmission line designs of the prior art.

Figure 3:
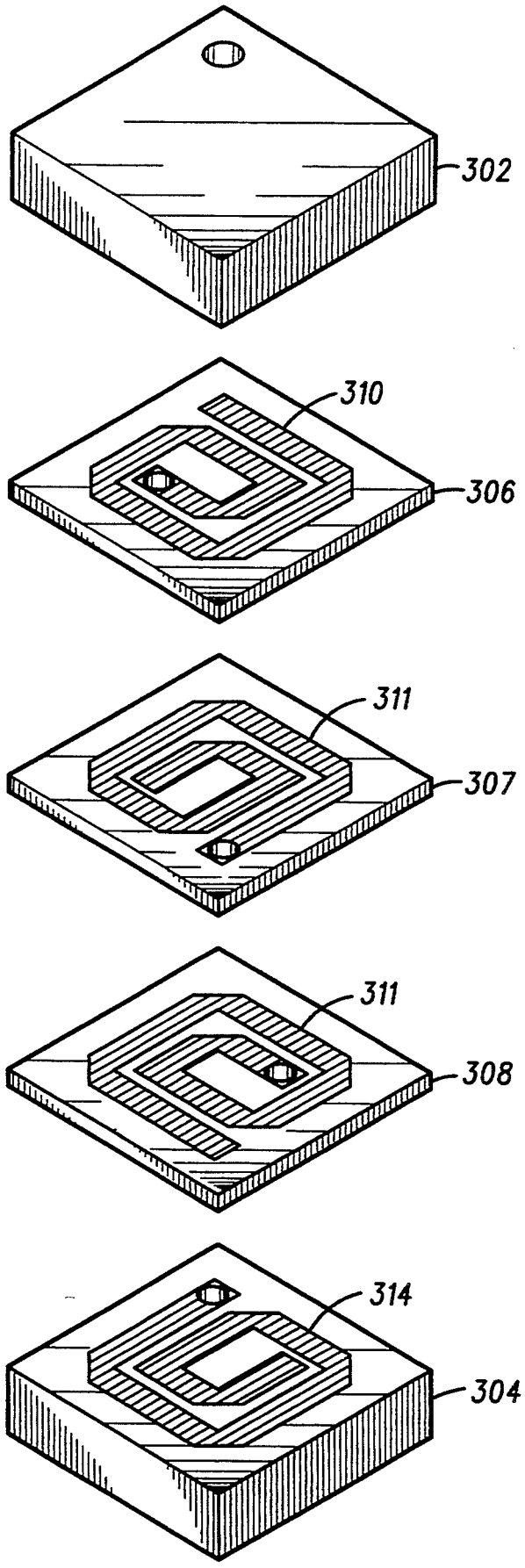
FIG. 3 shows a multilayer ceramic transmission line device using vertically stacked spiral conductors, in accordance with the present invention.
Figure 4A:
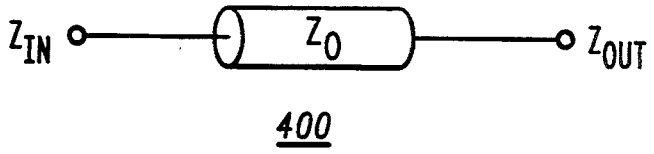
FIG. 4 shows a representative sampling of the applications for the electrical circuit, in accordance with the present invention.
Figure 4B:
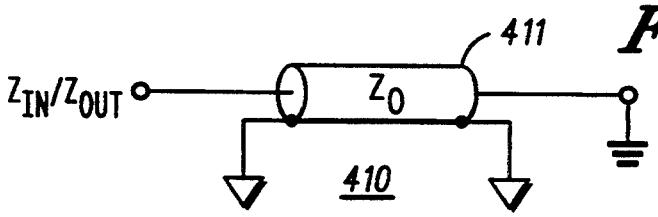
Figure 4C:
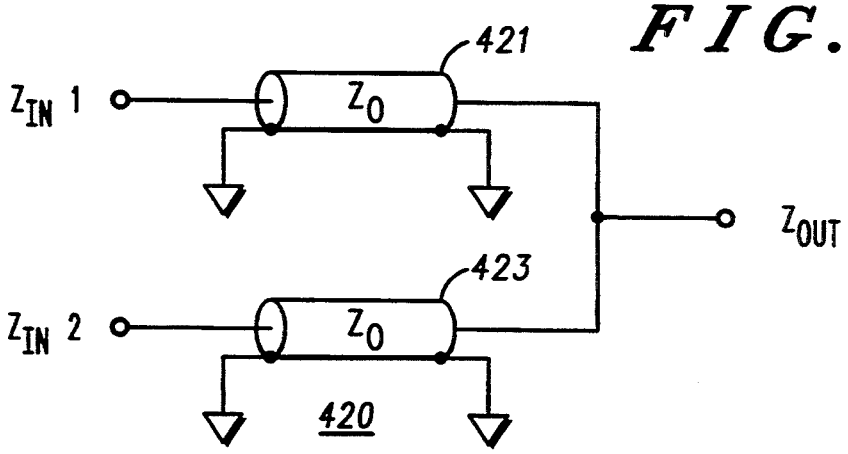
Figure 4D:
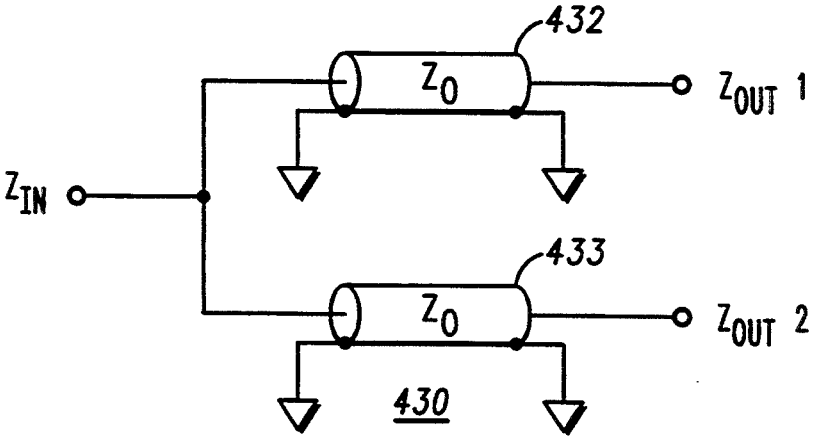

FIG. 3 shows yet another multilayer substrate arrangement 300 that employs spiral structures as the conductive layers. In particular, spiral conductors 310–312 and 314 are disposed on dielectric substrates 306–308 and 304, respectively, to effect a multilayer transmission line device in accordance with the present invention. Like the full-ring annulus structures described with reference to FIG. 2, the spiral structures advantageously provide increased physical—and electrical—length for those applications with such requirements. Generally, such applications typically include those circuits operating in the 100 MHz–3 GHz frequency range, which frequencies require longer conductive lengths than do high frequency applications. Accordingly, the present invention allows for the manufacture of a low-volume transmission line device that can be used at frequencies substantially lower than those frequencies attainable using prior art techniques.

FIG. 4A–D shows a multitude of circuit arrangements that advantageously employ transmission line devices, in accordance with the present invention. Arrangement 400 shows a simple impedance transforming device using a quarter-wave transmission line device 401. Generally, the transmission line device 401—having a characteristic impedance, $Z_0$, provides an impedance transformation from input impedance, $Z_{in}$, to output impedance, $Z_{out}$. In particular, a characteristic impedance for the transmission line device is chosen in accordance with the equation:

$$Z_0=(Z_{in}\cdot Z_{out})^{\frac{1}{2}} \quad (1)$$

Such impedance transformation devices are used, for example, in radio frequency (RF) power amplifiers and other communication circuits and often are required to consume minimal space. Similarly, circuit arrangement 410 represents a transmission line resonator that might typically represent a so-called quarter wavelength resonator. Such a device is made by shorting one end of the transmission line device 411 to ground. Such resonators are often employed in electrical circuits, such as voltage controlled oscillators (VCOs), RF chokes, and filter sections.

Circuit arrangement 420 shows a power combining device that utilizes a plurality of transmission line devices 421,423 (two shown, but could be more), in accordance with the invention. In such arrangement, two electrical signals are combined at a node 425 to form a single output. Impedance transformation is also realizable by choosing the proper $Z_0$ vales for transmission line devices 421,423. While these values are most typically chosen to be the same value, it is well understood that the $Z_0$ values may differ between the transmission line devices, depending on the applicaton. As an example, when the input impedances, $Z_{in1}$ and $Z_{in2}$ are the same, the characteristic impedance for the transmission line devices is given by the equation:

$$Z_0=(2Z_{in}\cdot Z_{out})^{\frac{1}{2}} \quad (1)$$

Similarly, circuit arrangement 430 shows a power splitting device that utilizes a plurality of transmission line devices 431, 433 (two shown, but could be more), in accordance with the invention. Like the power combiner 420, the power splitter 430 performs an impedance transformation in accordance with equation (2) above. Node 435 is utilized to split an input signal to the inputs for transmission line devices, whose outputs carry the split signals.

Of course, circuit arrangements 400, 410, 420 and 430 are known in the art. However, the advantages of employing multilayer technology to form transmission line devices becomes readily apparent as the number of required transmission line devices increases. That is, in circuit arrangements requiring two or more transmission line devices, the deleterious effects of bulky prior art components are substantially eliminated using the present invention. Further, when the plurality of layers required for a multiple-device circuit arrangement are manufactured on common dielectric substrates, performance benefits are also realized. Such performance benefits include, but are not limited to, an improved quality factor (Q), volume savings (and an associated structural rigidity of the finished product).

Figure 5:
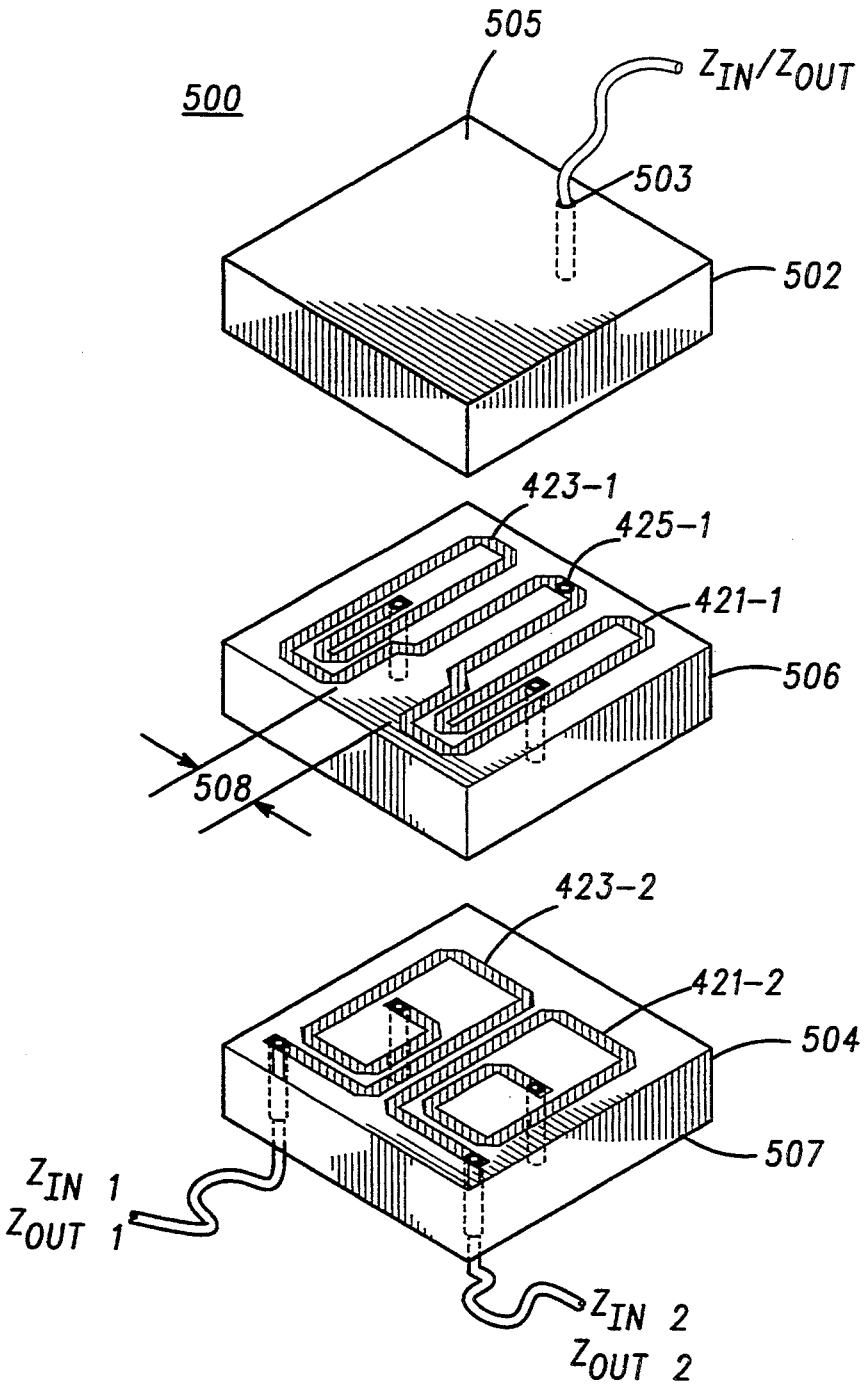
FIG. 5 shows a multilayer ceramic power splitter/-combiner, in accordance with the present invention.

FIG. 5 shows an exploded view of a power splitter/-combiner 500, in accordance with the present invention. Top substrate 502 includes an input/output terminal 503 for proving an input/output signal to/from the transmission line devices (e.g., 421, 423 shown in FIG. 4) Similarly, bottom substrate 504 includes output/input terminals for porting signals from/to the devices. As in the single coil embodiments described with reference to FIGS. 1–3, top substrate 502 includes a metallized area 505 that serves as a ground plane for the transmission line devices, while the bottom substrate preferably includes a second ground plane 507. In a preferred embodiment, intermediate dielectric substrate 506 supports primary conductive layers 421-1, 423-1 and node 425. It should be noted that undesired coupling between conductive layers 421-1 and 423-1 can be minimized by increasing the separation 508 or by minor adjustments in the conductive patterns, or layers 421-1, 423-1. A first major surface of the bottom substrate 504 supports secondary conductive layers 421-2, 423-2, which are disposed substantially adjacent to the intermediate substrate 506 (and connected to primary conductive layers 421-1, 423-1 using conductive vias, not shown). Manufacturing a power splitter/combiner in this manner allows for increased design flexibility because a broader range of $Z_0$ values can be attained in a smaller volume package.

Figure 6:
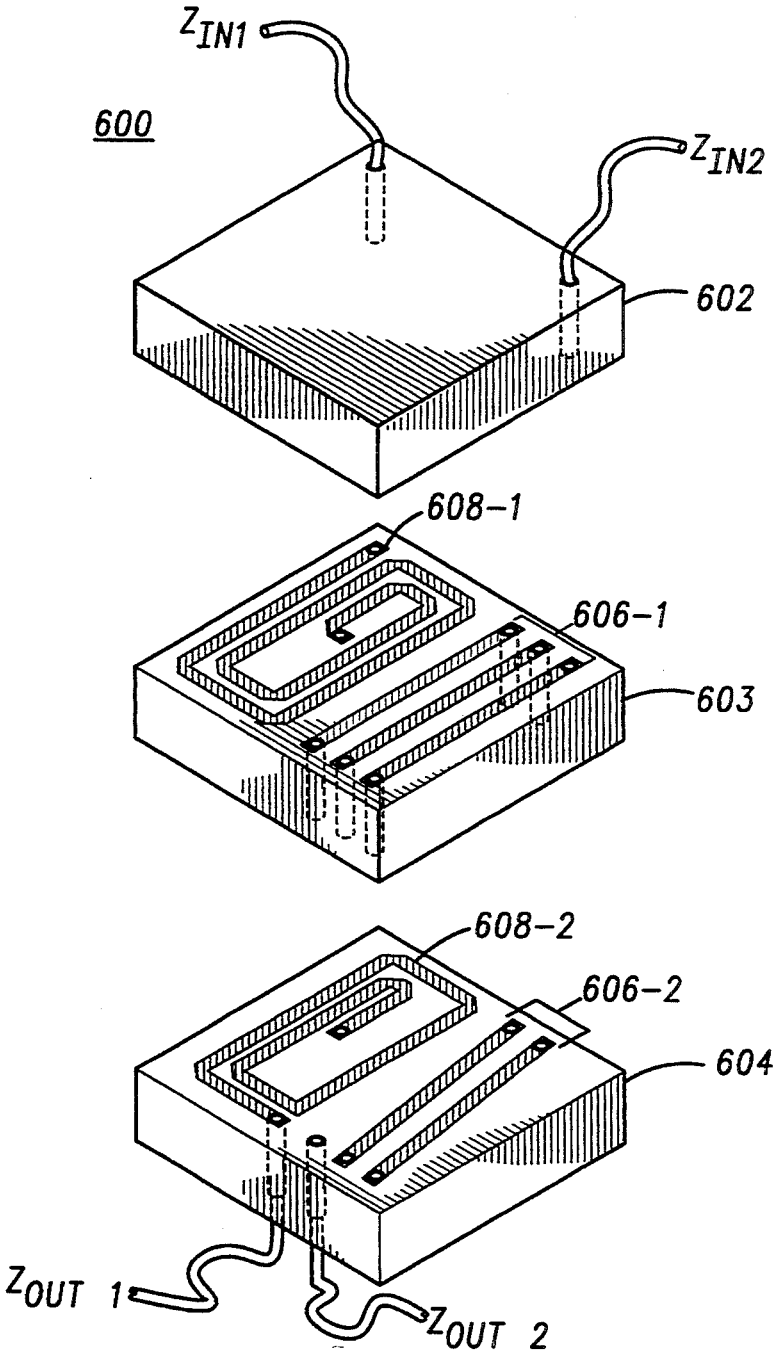
FIG. 6 shows a multiple transmission line device that advantageously employs a vertically stacked transmission line device and a horizontally stacked transmission line device.

FIG. 6 shows an exploded view of a multiple transmission line device 600, designed in accordance with the present invention. Top substrate 602 and a second major surface of bottom substrate 604 are effectively identical to those embodiments already described. Intermediate substrate 603 is shown to support the primary coil structure for both a horizontally stacked conductor 606 and a vertically stacked conductor. 608. The vertically stacked conductor 608 (i.e., spiral 608 T stacked onto spiral 608 is produced in substantially the same way as earlier described. The horizontally stacked conductor 606 is produced as follows: a plurality of conductive strips 606-1 are disposed on the intermediate dielectric. A second plurality of conductive strips 606-2 are arranged on a first major surface of the bottom substrate 604. Conductive strips 606-2 are arranged in such a manner as to, when connected to the conductive strips 606-1 by conductive vias (not shown), produce a horizontally oriented coil. Orienting a second of two required transmission line devices in this manner helps to avoid the problems of undesired electromagnetic coupling that would otherwise be present if the coils were substantially parallel to each other, as is common in prior art circuits.

What is claimed is:

1. An electrical circuit, comprising:

a first ground plane disposed on a first dielectric substrate;

a first multiple-turn coil, comprising:

a first plurality of conductive strips disposed on a second dielectric substrate, wherein the second dielectric substrate is positioned substantially adjacent to the first dielectric substrate;

a second plurality of conductive strips disposed on a first major surface of a third dielectric substrate, wherein the third dielectric substrate is positioned substantially adjacent to the second dielectric substrate; and conductive means for connecting the first plurality of conductive strips to the second plurality of conductive strips, wherein the first multiple-turn coil is formed using the first plurality of conductive strips and the second plurality of conductive strips; and a second multiple-turn coil, comprising:

a first conductive spiral disposed on the second dielectric substrate substantially adjacent to the first plurality of conductive strips; and a second conductive spiral disposed on the third dielectric substrate substantially adjacent to the second plurality of conductive strips.

2. The electrical circuit of claim 1, further comprising a second ground plane disposed on a second major surface of the third dielectric substrate.

* * * * *